US008273695B2

(12) United States Patent
Rochfort et al.

(10) Patent No.: US 8,273,695 B2
(45) Date of Patent: Sep. 25, 2012

(54) LUBRICANT AND SURFACE CONDITIONER FOR FORMED METAL SURFACES

(75) Inventors: Gary L. Rochfort, Shelby Township, MI (US); Richard D. Banaszak, Starling Heights, MI (US); Andrew M. Hatch, Lake Orion, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 1587 days.

(21) Appl. No.: 11/348,100

(22) Filed: Feb. 6, 2006

(65) Prior Publication Data

US 2007/0184202 A1 Aug. 9, 2007

(51) Int. Cl.
*C10M 129/70* (2006.01)
*C10M 129/16* (2006.01)

(52) U.S. Cl. ..... 508/501; 508/503; 508/579

(58) Field of Classification Search ..... 508/503, 508/501, 579
See application file for complete search history.

(56) References Cited

U.S. PATENT DOCUMENTS

| | | | | |
|---|---|---|---|---|
| 4,148,670 | A | 4/1979 | Kelly | |
| 4,944,889 | A | 7/1990 | Morland et al. | |
| 5,240,743 | A | 8/1993 | Tuller et al. | |
| 5,314,718 | A * | 5/1994 | Tuller et al. | 427/394 |
| 5,458,698 | A | 10/1995 | Bershas et al. | |
| 5,543,065 | A * | 8/1996 | Mudge | 252/8.84 |
| 6,040,280 | A * | 3/2000 | Kelly et al. | 508/503 |

FOREIGN PATENT DOCUMENTS

JP 2002275483 A 9/2002

OTHER PUBLICATIONS

International Search Report dated Oct. 31, 2007.
Henkel Corp. Technical Process Bulletin 235890.

* cited by examiner

*Primary Examiner* — Jim Goloboy
(74) *Attorney, Agent, or Firm* — Mary K. Cameron

(57) ABSTRACT

Improved lubricant and surface conditioner forming composition containing oxa acids and their methyl esters corresponding to general formula (I):

$$H_3C—(CH_2)_n—CH=CH—(CH_2)_m—O—(CH_2CH_2O)_x—CH_2—C(=O)—OR \quad (I)$$

where each of m, n and x, which may be the same or different, is a positive integer and R represents H or $CH_3$, when dissolved and/or dispersed in water is effective in reducing COF values on substrates that have been contacted with such a lubricant and surface conditioner forming composition and subsequently dried, even when the substrates have been conversion coated and rinsed before any contact with the lubricant and surface conditioner forming composition. Materials according to general formula (I) may be used together with other surfactants, including some constituents of previously known lubricant and surface conditioner forming compositions to provide improvements in COF, waterbreak performance, water drainage and resistance to dry-off of the conditioner.

11 Claims, No Drawings

LUBRICANT AND SURFACE CONDITIONER FOR FORMED METAL SURFACES

FIELD OF THE INVENTION

This invention relates to improvements in processes and compositions which accomplish at least one, and most desirably all, of the following related objectives when applied to formed metal surfaces, more particularly to the surfaces of cleaned, and optionally conversion coated, aluminum and/or tin plated cans: (i) reducing the coefficient of static friction of the treated surfaces after drying of such surfaces, without adversely affecting the adhesion of paints, including basecoats and inks, or lacquers applied thereto; (ii) promoting the drainage of water from treated surfaces; (iii) lowering the dry off oven temperature required for drying said surfaces after they have been rinsed with water and (iv) reducing the tendency of the composition to "bake-off" when exposed to longer oven times during line stoppages.

BACKGROUND OF THE INVENTION

The following discussion and the description of the invention will be set forth primarily for aluminum cans, however, both the discussion and the description of the invention apply also to tin plated steel cans and to other types of formed metal surfaces for which any of the above stated intended purposes of the invention are of interest.

Aluminum cans are commonly used as containers for a wide variety of products. After their manufacture, the aluminum cans are typically washed with acidic or alkaline cleaners to remove aluminum fines and other contaminants therefrom. Treatment of aluminum cans with either alkaline or acidic cleaners generally results in differential rates of metal surface etch on the outside versus on the inside of the cans. For example, optimum conditions required to attain an aluminum fine-free surface on the inside of the cans usually leads to can mobility problems on conveyors because of the increased roughness on the outside can surface. Aluminum cans that lack a low coefficient of static friction (hereinafter often abbreviated as "COF") on the outside surface usually do not move past each other and through the trackwork of a can plant smoothly. Clearing the jams resulting from failures of smooth flow is inconvenient for the persons operating the plant and costly because of lost production.

The COF of the internal surface is also important when the cans are processed through most conventional can decorators. The operation of these machines requires cans to slide onto a rotating mandrel which is then used to transfer the can past rotating cylinders which transfer decorative inks to the exterior surface of the cans. A can that does not slide easily on or off the mandrel cannot be decorated properly and results in a production fault called a "printer trip". In addition to the misloaded can that directly causes such a printer trip, three to four cans before and after the misloaded one are generally lost as a consequence of the mechanics of the printer and conveyor systems.

There is a need in the can manufacturing industry, particularly with aluminum cans, to modify the COF on the outside and inside surfaces of the cans to improve their mobility. Generally, the COF is reduced by the use of an aqueous surface treatment that includes a mobility enhancer. An important consideration in modifying the surface properties of cans is the concern that such modification may interfere with or adversely affect the ability of the cans to be printed when passed to a printing or labeling station. For example, after cleaning the cans, labels may be printed on their outside surface, and lacquers may be sprayed on their inside surface. In such a case, the adhesion of the paints, labels and lacquers is of major concern. It is therefore an object of this invention to improve mobility without adversely affecting adhesion of paints, decorating inks, lacquers, or the like. Another cause of printing and labeling defects is the presence of visible waterbreaks on the can surfaces. It is desirable that the amount of waterbreak on the cans be minimized. However, often the very component that enhances mobility of the can, e.g. oil or a particular surfactant, will increase the amount of waterbreak seen on the can surfaces.

In addition, the current trend in the can manufacturing industry is directed toward using thinner gauges of aluminum metal stock. The down-gauging of aluminum can metal stock has caused a production problem in that, after washing, the cans require a lower drying oven temperature in order to pass the column strength pressure quality control test. However, lowering the drying oven temperature resulted in the cans not being dry enough when they reached the printing station, which in turn caused label ink smears and a higher rate of can rejects. One solution to the problem of insufficient drying in the lower temperature drying oven is allow the cans to bake for longer, but this is economically impractical. A better solution is to reduce the amount of water remaining on the surface of the cans that is carried into the drying oven. Thus, it would be advantageous to have a lubricant and surface conditioner composition that promotes the drainage of rinse water from the treated can surfaces.

In summary, it is desirable to provide a means of improving the mobility of aluminum cans through single filers and printers to increase production, reduce line jams, minimize down time, reduce can spoilage, improve or at least not adversely affect ink laydown, and enable lowering the drying oven temperature of washed cans. Past improvements in this respect have led to increases in conventional can processing speeds, so that only the lower part of the range of previously acceptable COF values is now acceptable in many plants. One such improvement is disclosed in U.S. Pat. No. 6,040,280, the entire specification of which, except to any extent that it may be inconsistent with any explicit statement herein, is hereby incorporated herein by reference. The invention taught in the '280 patent provided good mobility, i.e. lowered the COF and slip angle, of cans treated therewith. One drawback of the '280 patent is the limited availability of raw materials required to make the mobility enhancer. Also, there is still a need to provide improvements over the '280 patent teachings such as a composition which can provide improvements in at least one of mobility performance, uniform wetting (low % waterbreak), drainage and bake-off characteristics. It is particularly desirable to provide a surface conditioner that decreases the amount of water carried on cans into the drying oven and that resists baking off in the oven.

In the most widely used current commercial practice, at least for large scale operations, aluminum cans are typically subjected to a succession of six cleaning and rinsing operations as described in Table A below. It is preferable to include another stage, usually called "Prerinse", before any of the stages shown in Table A; when used, this stage is usually at ambient temperature (i.e., 20-25 degrees C.) and is most preferably supplied with overflow from Stage 3 as shown in Table A, next most preferably supplied with overflow from Stage 1 as shown in Table A, and may also be tap water. Any of the rinsing operations shown as numbered stages in Table 1 may consist of two or preferably three sub-stages, which in consecutive order of their use are usually named "drag-out", "recirculating", and "exit" or "fresh water" sub-stages; if only two sub-stages are used, the name "drag-out" is omitted. Most preferably, when such sub-stages are used, a blow-off follows each stage, but in practice such blow-offs are often omitted. Also, any of the stages numbered 1 and 4-6 in Table A may be omitted in certain operations.

TABLE A

| Stage Number | Action On Surface During Stage |
|---|---|
| 1 | Aqueous Acid Precleaning |
| 2 | Aqueous Acid and Surfactant Cleaning |
| 3 | Tap Water Rinse |
| 4 | Mild Acid Postcleaning, Conversion Coating, or Tap Water Rinse |
| 5 | Tap Water Rinse |
| 6 | Deionized ("DI") Water Rinse |

An object of the present invention is to provide a lubricant and surface conditioner forming composition that will achieve satisfactory COF reduction, as shown by reduced slip angles, when used as the last aqueous treatment before drying the cans ("final rinse"), even on can surfaces already coated with a conversion coating by an earlier treatment stage. An alternative and/or concurrent objective is to overcome at least one of the difficulties with the prior art noted above. Other objects will be apparent from the further description below.

SUMMARY OF THE INVENTION

It is an object of the invention to provide a lubricant and surface conditioner forming composition that is an improvement over the prior art at least in that it is derived from readily available raw materials, provides improved water carry-out characteristics and reduced bake-off tendencies, while maintaining or improving waterbreak and slip angles performance.

In developing the instant lubricant and surface conditioner forming composition there were multiple performance attributes that had to be balanced, including:

1. Minimizing the amount of waterbreak on can surfaces, measured by the %-waterbreak free area on: exterior sidewall, interior sidewall and interior dome;
2. Reducing the coefficient of friction, measured by slip angle after a first bake;
3. Maintaining the lubricant and surface conditioner on the can during extended baking, measured by slip angle after a second bake;
4. Reducing water carry-out from the washer into the drying oven;
5. Foaming at the rinse stage: initial foam, persistent foam, rise time and decay time;
6. Availability and cost.

In balancing these performance criteria to obtain an industrially useful lubricant and surface conditioner forming composition, maximizing performance for one criteria must often be given up to improve performance for another criteria. That is, performance in all of these criteria need not be maximized provided that the overall performance provides a satisfactory result in an industrial setting. It is thus an object of the invention to provide a lubricant and surface conditioner forming composition that provides improvements in water drainage properties and reduced bake-off tendencies while maintaining a satisfactory degree of overall performance.

It is an object of the invention to provide a lubricant and surface conditioner forming composition comprising, preferably consisting essentially of, most preferably consisting of: a mobility enhancing surfactant and an auxiliary surfactant, i.e. co-surfactant, which meet one or more of the objectives recited herein. Other optional and conventional materials such as biocides, antifoam agents, and the like may also be included in the compositions according to the invention without changing the essence of the invention. It is another object of the invention to provide a lubricant and surface conditioner forming composition that is effective on metal substrates that have been contacted with such a lubricant and surface conditioner forming composition and subsequently dried, even when the substrates have been conversion coated and rinsed before any contact with the lubricant and surface conditioner forming composition.

In accordance with this invention, it has been found that oxa acids and their methyl esters corresponding to general formula (I):

$$H_3C—(CH_2)_n—CH=CH—(CH_2)_m—O—(CH_2CH_2O)_x—CH_2—C(=O)—OR \quad (I)$$

where each of m, n and x, which may be the same or different, is a positive integer and R represents H or $CH_3$, when dissolved and/or dispersed in water provide an excellent mobility enhancing surfactant component for the lubricant and surface conditioner forming composition. The materials of formula (I) may be denoted hereinafter as the "primary lubricant and surface conditioner forming component", "primary surfactant", "mobility surfactant" or "mobility enhancer".

Materials according to general formula (I) are used together with other surfactants, denoted hereinafter as "co-surfactant", including some constituents of previously known lubricant and surface conditioner forming compositions. Polyalkylene oxide block containing ethers and esters are particularly useful auxiliary surfactants when used together with compounds according to formula (I).

Various embodiments of the invention include a concentrated additive that when mixed with water will form a working aqueous liquid lubricant and surface conditioner forming composition as described above; such an aqueous liquid working composition itself; and processes including contacting a metal surface, particularly but not exclusively a previously conversion coated aluminum surface, with such an aqueous liquid working composition.

Other than in the operating examples, or where otherwise indicated, all numbers expressing quantities of ingredients, reaction conditions, or defining ingredient parameters used herein are to be understood as modified in all instances by the term "about". Unless otherwise indicated, all percentages are percent by weight.

Also, throughout the specification, unless there is an explicit statement to the contrary: the description of groups of chemical materials as suitable or preferred for a particular ingredient according to the invention implies that mixtures of two or more of the individual group members are equally as suitable or preferred as the individual members of the group used alone; the specification of chemical materials in ionic form should be understood as implying the presence of some counterions as necessary for electrical neutrality of the total composition; in general, such counterions preferably should first be selected to the extent possible from the ionic materials specified as part of the invention; any remaining counterions needed may generally be selected freely, except for avoiding any counterions that are detrimental to the objects of the invention; any explanation of an abbreviation applies to all subsequent uses of the same abbreviation and applies mutatis mutandis to grammatical variations of the initial abbreviation.

DETAILED DESCRIPTION OF PREFERRED EMBODIMENTS

The lubricant and surface conditioner forming composition according to the invention is an improvement over the prior art at least in that it is derived from readily available raw materials, provides improved water carry-out characteristics and reduced bake-off tendencies, with little or no loss of waterbreak, COF reduction and foaming performance, as compared to the prior art. In accordance with this invention, it has been found that oxa acids and their methyl esters corresponding to general formula (I):

$$H_3C—(CH_2)_n—CH=CH—(CH_2)_m—O—(CH_2CH_2O)_x—CH_2—C(=O)—OR \quad (I)$$

where each of m, n and x, which may be the same or different, is a positive integer and R represents H or $CH_3$, when dissolved and/or dispersed in water provide an excellent lubricant and surface conditioner forming composition that is effective in reducing COF values on metal substrates that have been contacted with such a lubricant and surface conditioner forming composition and subsequently dried, even when the substrates have been conversion coated and rinsed before any contact with the lubricant and surface conditioner forming composition.

In general formula (I), the value of m preferably is at least, with increasing preference in the order given, 2, 3, 4, 5, 6, 7, 8, 9, 10, or 11 and independently preferably is not more than, with increasing preference in the order given, 20, 19, 18, 17, 16, 15, 14, 13, or 12; independently, the value of n preferably is at least, with increasing preference in the order given, 3, 4, 5, 6, 7, 8, 9, 10, or 11 and independently preferably is not more than, with increasing preference in the order given, 20, 19, 18, 17, 16, 15, 14, 13, or 12; independently, the value of x preferably is at least, with increasing preference in the order given, 2, 3, 4, 5, 6, 7 or 8 and independently preferably is not more than 25, 23, 21, 19, 17, 15, 14, 13, 12, or 11. Additionally and independently, at least 20% of the molecules present that conform to general formula (I) preferably do so when the value of x is at least, with increasing preference in the order given, 7, 8, 9, 10, or 11. It is desirably that at least, in increasing order of preference, 80, 85, 90, 92, 94, 96, 98 or 99 weight % of the mobility surfactant correspond to formula (I).

In order to obtain good performance for compositions of the invention in reducing waterbreak and water carryout into drying ovens, an auxiliary surfactant, i.e. a co-surfactant, is used. Auxiliary surfactants used in a working lubricant and surface conditioner forming composition according to the invention can be those surfactants known in the art to improve waterbreak characteristics. Suitable auxiliary surfactants include alkoxylated hydrocarbons and are preferably selected from the group consisting of materials corresponding to one of the general formulas (II)-(V):

$$R_1O(CH_2CH_2O)_y(CH_2CHCH_3O)_zH \quad (II),$$

$$R_2C(O)O(CH_2CH_2O)_pH \quad (III),$$

$$HO(CH_2CH_2O)_q(CH_2CHCH_3O)_r(CH_2CH_2O)_{q'}H \quad (IV),$$

$$HO(CH_2CHCH_3O)_s(CH_2CH_2O)_t(CH_2CHCH_3O)_{s'}H \quad (V),$$

where: $R_1$ is a moiety selected from the group consisting of (i) saturated and unsaturated straight and branched chain aliphatic monovalent hydrocarbon moieties and (ii) saturated and unsaturated straight and branched chain aliphatic monovalent hydrocarbon moiety substituent bearing phenyl moieties in which the aromatic ring is directly bonded to the oxygen atom appearing immediately after the $R_1$ symbol in formula (II); y represents a positive integer that preferably is at least, with increasing preference in the order given, 2, 3, 4, 5, 6, 7, 8 and independently preferably is not more than with increasing preference in the order given, 30, 25, 20, 18, 16, 14, 12, or 10; z is zero to 20;

$R_2$ is selected from the group consisting of saturated and unsaturated straight and branched chain aliphatic monovalent hydrocarbon moieties; p is a positive integer;

each of q and q', which may be the same or different but are, primarily for reasons of economy, preferably the same, represents a positive integer that independently preferably is at least 2, or more preferably is at least 3, and independently preferably is not more than, with increasing preference in the order given, 10, 9, 8, 7, 6, 5, 4, or 3; r represents a positive integer that preferably is at least, with increasing preference in the order given, 3, 5, 8, 12, 16, 20, 24, 26, 28, or 29 and independently preferably is not more than with increasing preference in the order given, 60, 55, 50, 45, 41, 38, 36, 34, 32, or 31;

each of s and s', which may be the same or different but are, primarily for reasons of economy, preferably the same, represents a positive integer that independently preferably is at least, with increasing preference in the order given, 10, 15, 20, 22, 24, or 26 and independently preferably is not more than, with increasing preference in the order given, 63, 55, 48, 42, 37, 33, 30, or 28; and t represents a positive integer that preferably is at least, with increasing preference in the order given, 2, 3, 4, 5, or 6 and independently preferably is not more than, with increasing preference in the order given, 20, 18, 16, 14, 12, 10, 8, 7, or 6.

In one embodiment, $R_1$ independently may comprise an aliphatic structure, which may be linear or branched, preferably branched, most preferably a branched saturated structure. Independently, $R_1$ is desirably a $C_{10}$-$C_{16}$ structure.

In another embodiment, $R_1$ independently may comprise an alkyl substituted phenyl ring. The aliphatic portion may be linear or branched, preferably branched, most preferably a branched saturated structure. Also, independently of these other preferences and independently for each of moieties $R_1$ and $R_2$, the total number of carbon atoms in the moiety preferably is at least, with increasing preference in the order given, 8, 10, 11, 12, 13, or 14 and independently preferably is not more than, with increasing preference in the order given, 22, 21, 20, 19, or 18. In a preferred embodiment, $R_1$ comprises a nonylphenol moiety.

The ratio of (i) the total concentration of auxiliary surfactant according to one or more of general formulas (II) through (V) to (ii) the concentration of primary lubricant and surface conditioner forming component according to formula (I) is not greater than, with increasing preference in the order given, 20:1.0, 19.0:1.0, 18.0:1.0, 17.0:1.0, 16.0:1.0, 15.0:1.0, 14.0:1.0, 13:1, 12:1, 11:1 or 10.5:1 and, independently preferably is at least, with increasing preference in the order given, 5.0:1.0, 6.0:1.0, 7.0:1.0, 7.5:1.0, 8.0:1.0, 8.5:1.0, 9.0:1.0.

In a working aqueous liquid lubricant and surface conditioner forming composition according to the invention, the total concentration of material corresponding to any of general formulas (I) through (V) above preferably is at least, with increasing preference in the order given, 0.001, 0.002, 0.004, 0.007, 0.010, 0.020, 0.030, 0.035, 0.040, 0.044, 0.048, 0.052, 0.056, 0.060, 0.064, 0.068, 0.072, 0.076, 0.080, 0.084, 0.088, 0.092, 0.096, or 0.100 grams per liter (hereinafter usually abbreviated as "g/L") and independently preferably is, primarily for reasons of economy, not more than, with increasing preference in the order given, 1.0, 0.90, 0.80, 0.70, 0.60, 0.50, 0.40, 0.35, 0.30, 0.25, 0.21, 0.17, 0.15, 0.13, or 0.11 g/L.

In a concentrate composition according to the invention, suitable for preparing such a working aqueous liquid lubricant and surface conditioner forming composition by mixing the concentrate composition with water, the total concentration of material corresponding to any one of general formulas (I) through (V) preferably is at least, with increasing preference in the order given, 0.5, 1.0, 1.3, 1.6, 1.9, 2.2, 2.5, 3.0, 3.5, 4.0, 4.5, 5, 5.5, 6, 6.5, 7.5, 8.5, 9% and independently preferably is not more than, with increasing preference in the order given, 18, 17, 16, 15, 14, 13, 12, 11%. Although this amount may be higher, the composition can reach too high a viscosity for ready dispersion in a bath and may undergo phase separation at levels of water below 70 wt. %.

A lubricant and surface conditioner forming composition according to the invention preferably is contacted with the surface previously prepared by conversion coating at the normal ambient temperature prevailing in spaces conditioned for human comfort, i.e., between 15 and 30 degrees C., or more preferably between 20 and 25 degrees C., although any temperature at which the composition is liquid can be used. When contact is at the preferred temperature, the time of contact preferably is at least, with increasing preference in the order given, 1, 2, 3, 5, 7, 9, 11, 13, 15, 17, 18, or 19 seconds (hereinafter usually abbreviated as "sec") and independently, primarily for reasons of economy, preferably is not more than, with increasing preference in the order given, 600, 300, 200, 180, 150, 120, 100, 80, 70, 60, 50, 40, 35, 30, 26, 23, or 21 sec.

After contact with the lubricant and surface conditioner forming composition according to the invention and subsequent drying, the COF value achieved on the exterior side wall of the cans treated preferably is not more than, with increasing preference in the order given, 1.0, 0.90, 0.80, 0.75, 0.70, 0.65, 0.60, 0.55, 0.50, 0.45, or 0.40. These COFs correspond to slip angles according to the formula tangent (slip angle)=COF. Slip angles of cans treated with the lubricant and surface conditioner forming composition of the invention are in increasing order of preference less than 35, 33, 31, 30, 29, 28, 27, 26, 25, 25, 23, 22, 21, 20 degrees.

It is also desirable that compositions of the invention provide substantially waterbreak free can surfaces after contact with the lubricant and surface conditioner forming composition. The can surfaces inspected for waterbreaks are typically the exterior side wall (ESW), the interior dome (ID) and the interior side wall (ISW). Each of these surfaces may give a different result due to the nature of the can forming process. The inspection is performed by a technician through visual observation of the can surfaces with the unaided human eye. The percentage of the can that is waterbreak free is estimated based upon this inspection. Desirably, the percent waterbreak free of the can surfaces is, in increasing order of preference, 85, 87, 89, 90, 91, 92, 93, 94, 95, 96, 97, 98, 99 or 100%. When balancing the various desired attributes of a lubricant and surface conditioner forming composition, it is preferred that the can surfaces be at least 90 percent, more preferably at least 95% and most preferably at least 98% waterbreak free.

Another desirable feature of the lubricant and surface conditioner forming composition is the reduction in water carry out from the final stages of can treatment and into the can dryers. After aluminum cans are cleaned and rinsed in a commercial can washer, they must be thoroughly dry before application of their exterior decorative ink labels. For production efficiency and fuel economy it is desirable to process as many cans through the washer oven at as low a temperature as possible while ensuring that all traces of water have been removed from them. With thinner can stock, even lower drying oven temperatures are desirable, and obtaining a sufficiently dry can, without added time spent in the oven is an object of this invention. To achieve this object it is desirable that the cans and the conveyor belt they are riding on carry as little water into the oven as possible. Various mechanical means such as air knives (blow offs), mat wipes and vacuum operated mat strippers have been used to accomplish this. By the addition of suitable surfactants to the final rinse bath, it is possible to reduce the amount of water carried into the washer oven still further. Without being bound by a single theory, it is believed that this effect is attributable to the ability of surfactants to reduce the surface tension of the liquid resulting in more rapid and complete drainage of the final rinse liquid from the cans and mat.

In order to measure the effectiveness of surfactants in the lubricant and surface conditioner forming composition in reducing water carry out, Applicants developed the Drop Volume (DV) test. It has been observed that pure water dripping from a small bore capillary tends to form drops which grow to very large sizes before gravity overcomes the forces keeping the drop attached to the capillary. It has also been observed that the addition of a surfactant to the water results in a decrease in the droplet's size prior to detachment. The adhesive and cohesive forces holding the droplet to the capillary and the liquid contained therein are generally the same ones responsible for holding the final rinse water on the can and conveyor. The average droplet size (in microliters, μL) depends on the concentrations and natures of the surfactants in the solution. The volume of water drops containing the lubricant and surface conditioner forming composition is believed to be more closely correlated to the actual water carry out in the industrial plant setting than the Water Carry Out (WCO) test of the prior art using a conveyor belt can washer. The conveyer belt, using a single can with four contact points, is considered to be less accurate at simulating can treating conditions, where the cans in an industrial washer have at least 12 contacts with other cans. The Drop Volume (DV) test was used to estimate the volume of water that would be carried into the dryer on the surfaces of the cans and is considered more reproducible than the Water Carry Out (WCO) test of the prior art, particularly where the simpler DV test reduces the potential for operator caused variability in results.

Lubricant and surface conditioner forming compositions of the invention provide improved water carry out properties. That is, testing against the prior art has shown that the instant invention performs better in the Drop Volume test, which is indicative of improved water drainage resulting in reduced amounts of water being carried into the drying oven. The instant lubricant and surface conditioner forming composition thus facilitates lower drying oven temperatures by reducing the amount of water that must be dried from the can surfaces.

Excessive foaming and foam that does not dissipate quickly are additional problems encountered when using surfactants in a spray system, such as a can washer. Excessive foaming in spray-applied products can be a major problem with lubricant and surface conditioner forming compositions such as those that are the subject of the instant invention. The problem is exacerbated by the high surface activity of any co-surfactant used. It is desirable that the lubricant and surface conditioner forming composition of the invention gives a foam rise time and foam decay performance, when tested according to the methods recited herein, that is approximately the same, and preferably an improvement on the prior art. It is preferred that compositions of the invention provide a foam rise time of 3, 4, 5 minutes or more and/or provides foam+liquid volume after 10 minutes of decay of 4,000; 3900, 3850, 3800, 3750, 3700, 3600, 3500, 3400 ml or less.

When balancing the various desired attributes of a lubricant and surface conditioner forming composition as recited above, not all features can be optimized simultaneously. A surfactant's capacity to enhance mobility tends to reduce the surfactant's ability to produce waterbreak free cans. Since mobility and waterbreak free are desired features of a treated can, a lubricant and surface conditioner forming composition that provides sufficient mobility with minor waterbreaks, is considered an improvement over those lubricant and surface conditioner forming compositions that meet one criterion or the other, but not both.

The lubricant and surface conditioner forming composition of the invention can be used on clean uncoated can surfaces or can be applied after a conversion coating has been deposited on the can surfaces. Conversion coating which is contacted with a lubricant and surface conditioner forming composition according to this invention can be formed by a variety of such coatings known in the art and preferably has been formed as described in U.S. Pat. No. 4,148,670 of Apr. 10, 1979 to Kelly, the entire specification of which, except to any extent that it may be inconsistent with any explicit statement herein, is hereby incorporated herein by reference. The effective fluoride activity of the conversion coating forming aqueous liquid composition for purposes of this description is measured by use of a fluoride sensitive electrode as described in U.S. Pat. No. 3,431,182 and commercially available from Orion Instruments. Fluoride activity was specifically measured relative to Activity Standard 120MC commercially available from the Henkel Corporation by a procedure described in detail in Henkel Corporation Technical Process Bulletin No. 235890 dated Jan. 3, 1994. The Orion Fluoride Ion Electrode and the reference electrode provided with the Orion instrument are both immersed in the noted Standard Solution and the millivolt meter reading is adjusted to zero. The electrodes are then rinsed with deionized or distilled water, dried, and immersed in the sample to be measured, which should be brought to the same temperature as the noted Standard Solution had when it was used to set the meter reading to 0. The reading of the electrodes immersed in the sample is taken directly from the millivolt (hereinafter often abbreviated "mv" or "mV") meter on the instrument. With this instrument, lower positive mv readings indicate higher fluoride activity, and negative mv readings indicate still higher fluoride activity than any positive readings, with negative readings of high absolute value indicating high fluoride activity. The fluoride activity of the conversion coating forming composition preferably is not more than, with increasing preference in the order given, −50, −60, −70, −80, −85, or −89 mv and independently preferably is at least, with increasing preference in the order given, −120, −115, −110, −105, −100, −95, or −91 mv.

The temperature at which the conversion coating composition is contacted with the metal substrate being treated, before being contacted with a lubricant and surface conditioner forming composition according to the invention, preferably is at least, with increasing preference in the order given, 25, 30, 35, 38, or 40 degree C. and independently preferably is, primarily for reasons of economy, not more than, with increasing preference in the order given, 70, 60, 55, 50, 45, 43, or 41 degree C., and the time of contact at these temperatures preferably is at least, with increasing preference in the order given, 1, 3, 5, 7, 9, 11, 13, 15, 17, 19, 21, 23, or 24 sec and independently preferably is, primarily for reasons of economy, not more than, with increasing preference in the order given, 600, 300, 200, 180, 150, 120, 100, 80, 70, 60, 50, 40, 35, 32, 29, 27, or 26 sec.

Before conversion coating, the metal surface to be treated should be well cleaned, preferably with an acid cleaning composition, more preferably one that also contains fluoride and surfactants. Suitable cleaners are known to those skilled in the art.

The invention and its advantages may be further appreciated by consideration of the following working examples and comparisons.

EXAMPLES

Materials Used

Alodine®404 is a non-chromate conversion coating process for drawn and ironed aluminum cans, which conforms to the preferred teachings of U.S. Pat. No. 4,148,670. Needed materials and directions are available from Henkel Corporation.

Aluminum nitrate was used in the form of a 59.5-61% solution of aluminum nitrate nonahydrate in water.

Aluminum sulfate was used in the form of technical alum with an average molecular weight of 631.34 and 8.55% of aluminum atoms, with two such atoms per molecule.

Ammonium bifluoride, technical grade, >97%, typically 98.3%, of $NH_4HF_2$, with the balance predominantly $NH_4F$, was used.

Ammonium hydroxide, 26.degree. Baume, technical grade, was used when needed to adjust free acid and/or pH values. (This material is also referred to as "aqueous ammonia".)

A1 surfactant was a polyoxyethylene (8) $C_{18}$ mono-unsaturated alkyl carboxylic acid.

A2 surfactant was a polyoxyethylene (9) $C_{18}$ mono-unsaturated alkyl carboxylic acid.

A3 surfactant was a polyoxyethylene (10) $C_{18}$ mono-unsaturated alkyl carboxylic acid.

A4 surfactant was a polyoxyethylene (11) $C_{12}$-$C_{15}$ saturated alkyl carboxylic acid.

A5 surfactant was a polyoxyethylene (11) $C_{12}$-$C_{14}$ saturated alkyl carboxylic acid.

A6 surfactant was a polyoxyethylene (7) $C_{13}$ branched saturated alkyl carboxylic acid.

A7 surfactant was a polyoxyethylene (10) $C_{12}$ saturated alkyl carboxylic acid.

A8 surfactant was a polyoxyethylene (3) $C_{12}$ saturated alkyl carboxylate.

A9 surfactant was a polyoxyethylene (5) $C_{18}$ mono-unsaturated alkyl carboxylic acid.

A10 surfactant was a mixture of carboxymethyl polyglycol alkyl ethers, thought to be about 50% polyoxyethylene (4-6) $C_{12}$—$CH_2$—C(=O)OH.

A 11 surfactant was a polyoxyethylene (9) $C_{16-18}$ saturated alkyl carboxylic acid.

A12 surfactant was a polyoxyethylene (10.5)) $C_{16-18}$ saturated alkyl carboxylic acid.

B1 co-surfactant was a polyethoxylated (9) nonyl-phenol.

B2 co-surfactant was an unsaturated polyoxyethylene (20) $C_{18}$ alkyl alcohol.

B3 co-surfactant was a polyoxyethylene (8) $C_{13}$ branched saturated alkyl alcohol.

B4 co-surfactant was a polyoxyethylene (6) $C_{13}$ branched saturated alkyl alcohol.

Ridoline®123 concentrate is suitable for making a fluoride containing acidic cleaner for drawn and ironed aluminum cans. The concentrate and directions for using it are commercially available from Henkel Corporation.

All other materials identified by chemical name below were reagent grade materials.

Cleaner Solutions

The cleaning solutions were formulated to approximate an "aged" cleaner typically found in industrial cleaning conditions. In an industrial setting, aluminum dissolved from the cans builds up in the sulfuric acid containing cleaner. Aluminum sulfate was added to approximate industrial conditions for processing aluminum cans. The cleaning solutions were prepared to be substantially the same as a typical used cleaner bath comprising Ridoline®123 concentrate and aluminum sulfate sufficient to provide a 9 ml Free Acid Value and a Total Acid Value of 22 ml, an amount of ammonium bifluoride and/or aqueous hydrofluoric acid (Reagent Grade at 52%) sufficient to provide a fluoride activity of +15 millivolts and water. The Free Acid, Total Acid and Fluoride Activity of the cleaner solution were checked as described in the Henkel Corporation Technical Process Bulletin No. 235890, dated Jan. 3, 1994 for the Ridoline®123 Process. In addition to the five components listed above, ammonia was added if the Free Acid of the initially prepared solution was higher than desired.

Conversion Coating Solutions

A 0.5 volume/volume % solution of Alodine®404 concentrate was prepared. Aqueous ammonia was added as required to adjust the pH of the solution to the desired value. Aluminum nitrate solution was added to adjust the Fluoride Activity to −90 mV. The temperature of this solution was maintained at 40.5° C. as it was sprayed onto the cleaned cans.

Lubricant and Surface Conditioner Forming Compositions

The lubricant and surface conditioner forming compositions were prepared by adding to deionized water the surfactants and/or co-surfactants to be tested. The amounts of mobility enhancing surfactant and/or co-surfactant used in each formulation was adjusted to provide approximately the same molar concentrations of those materials in each formulation, with the exception of the controls where surfactant or co-surfactant was completely omitted. The molecular weight of each species was calculated from the nominal composition. Initial testing was done using a fixed ratio of mobility active surfactant to co-surfactant of 4 parts mobility surfactant (activity corrected) to 32 parts co-surfactant. Specifics regarding amounts are reported in tables below.

The slip angles from commercial mobility enhancers vary with pH. Thus for screening purposes all candidates were run at pH 5, which is within the range of typical pHs used in the field. Concentrations at which to test the candidate lubricant and surface conditioner forming compositions were selected to simulate amounts used in typical industrial can plants.

Apparatus and Procedure

All cans were prepared on a laboratory carousel can washer designed such that, in most respects, it closely simulates commercial scale operations. Time periods for rinsing, standing, and blowing-off operations are higher in the laboratory apparatus, because it has only a single spray chamber, which must be used for all stages of the process. As a result, longer draining, rinsing, and blowing-off times are required in the laboratory apparatus to avoid contamination. In commercial scale apparatus, there are separate chambers for each spraying and blowing-off step, so that much shorter times can be used. Extensive experience, however, has established that this difference between laboratory and commercial practice does not normally affect the results achieved.

The can surfaces were observed for the percentage of the surface that was water break free after Step 7 and before drying. The percent of can surface that is water break free is desirably at least 90% for industrial uses. Waterbreak was determined by a visual assessment of the exterior, interior and dome surfaces. The cans were then sent to the first bake and the slip angles measured according to the below-described slip angle testing procedure. The cans were returned to the oven for the second bake and their slip angles measured again. A smaller slip angle is evidence of a lower, and hence more desirable, COF. The second bake is not part of commercial cycles; it was used to approximate conditions to which the cans are subjected when a line stoppage occurs and the cans are left in the drying oven for longer than normal drying time.

Each run used fourteen cans. The procedure used to prepare the cans is given in Table 1 unless otherwise noted below.

TABLE 1

Can Treatment Process

| | Composition | pH | mV | Free Acid | Total Acid | Temp. | Time | psi |
|---|---|---|---|---|---|---|---|---|
| 1- prewash | sulfuric acid | 2.0 | — | — | — | 130° F. | 30 | 20 |
| 2- cleaner | Ridoline ® 123 | — | 15 | 9 | 22 | 140° F. | 60 sec | 20 |
| 3- rinse | tap water | — | — | — | — | — | — | 7-10 |
| 4- | None or 0.5% Alodine ® 404 | 2.8 | −70.0 | — | — | 105.0 | 20.0 | 7-10 |
| 5- rinse | tap water | — | — | — | — | — | 30 | 7-10 |
| 6- rinse | DI water | — | — | — | — | — | 90 | 7-10 |
| 7- | FRME | 5.0 | — | — | — | — | 30 | 7-10 |
| Dry, 1st Bake | Oven | — | — | — | — | 150° C. | 5 min. | — |
| Dry, 2nd Bake | Oven | — | — | — | — | 150° C. | 5 min. | — |

FRME means Final Rinse Mobility Enhancer, which include lubricant and surface conditioner forming compositions.

Example 1

Measuring Slip Angle of the Exterior Sidewalls

Candidate lubricant and surface conditioner forming compositions were formulated as recited in Table 2. The surfactants were provided as aqueous solutions at a concentration of 5% and the co-surfactants were provided as aqueous solutions at a concentration of 10%. The process baths were built by parts from these aqueous solutions. Commercial grade aluminum cans were treated according to the procedure recited above, using the formulations of Table 2 at Step 7 and water at Step 4.

The cans were evaluated for slip angle with a laboratory static friction tester. This device measures the static friction associated with the outside sidewall surface characteristics of aluminum cans. This is done by using a ramp that is raised through an arc of 90°, manually or by using a constant speed motor, a spool and a cable attached to the free-swinging end of the ramp. A cradle attached to the bottom of the ramp is used to hold two cans on their sides in horizontal position approximately 13 millimeters apart, with their domes facing the fixed end of the ramp and restrained from sliding along the ramp as it is raised. A third can is laid on its side upon the first two cans, with the dome of the third can facing the free swinging end of the ramp, and the edges of all three cans are aligned so that they are even with each other. The cradle does not restrain the movement of the third can. The free end of the ramp is elevated until the super-mounted third can is observed to begin to slide against the stationary lower cans.

This test conforms largely to the description of its predecessor given in U.S. Pat. No. 4,944,889 and U.S. Pat. No. 5,458,698. These patents measured the time it took from the beginning of the ramp's movement until the super-mounted can slipped out of the path of an electric eye. This "slip time" was converted to a slip angle using an empirically derived equation based upon the characteristics of the particular device used. The slip angle was then converted to a coefficient of friction using the equation tan (slip angle)=COF.

In the test procedure used for the instant invention, Applicants directly measured the "slip angle". At the moment that the third can began to slide relative to the two stationary cans, the angle of the ramp relative to the horizontal defined the cans' "slip angle." An electric motor was used to elevate the ramp, as the ramp was elevated the increasing angle of the ramp was detected using an optical encoder and the ramp angle was displayed on a readout. When the super-mounted can slid out of the plane of an electric eye focused on the can, the optical encoder stopped and the readout displayed the slip angle for those cans.

The test procedure was to prepare cans (at least 3 and preferably at least 6, 12, 15) with the candidate mobility enhancer. These cans were tested in randomly selected combinations until at least 15 slip angles had been determined for averaging. The results are recorded in Table 2, where ESW means exterior sidewall; ID means interior dome; ISW means interior sidewall. First Bake Slip Angle is the slip angle of cans after the first oven dry after Step 7 in Table 1; and second Bake Slip Angle is the slip angle of cans after the second oven dry in the same table.

Comparative Formulation S was a benchmark composition according to U.S. Pat. No. 6,040,280, made up of A4 in combination with B1, where these materials serve as the active mobility agent and co-surfactant respectively. FRME baths containing the single surfactants B1 or B3 or fully formulated commercial product of Comparative Formulation S produced waterbreak free cans while a FRME bath containing only A4 had a significant amount of waterbreak on the exterior sidewall. Some waterbreak was seen on most of the cans treated with the candidate surfactant mixtures. The waterbreak on cans treated with the A1 formulation was particularly noticeable, those cans being only 65-75% WBF on the ESW, depending on the concentration used.

In the absence of an AL-404 pretreatment, the candidate FRMEs gave slip angles ranging from 18° to 46° depending on their compositions and concentration. Formulations containing A1, A2 or A3 as the mobility enhancing surfactant had single bake angles less than or equal to that of formulations using A4, in the lower concentration array. Following a second bake, cans treated with the A3 formulation suffered a much smaller increase in their slip angles compared to cans treated with the other formulations.

Effect of Conversion Coating on Slip Angle and Waterbreak

The procedure of Measuring Slip Angle of the Exterior Sidewalls, recited above, was repeated using cans that were conversion coated with Alodine 404 in Step 4. Conversion coating is typically applied to containers in the can industry to, among other benefits, improve waterbreak performance. However, it can affect the coefficient of friction and slip angle, and this performance is typically also tested. The results are recorded in Table 3.

TABLE 2

Non-conversion coated cans

| Example 1 | Amount of 5% Surfactant Solution | | Amount of 10% Co-surfactant Solution | | % Water Break Free | | | Slip Angle | |
|---|---|---|---|---|---|---|---|---|---|
| Formulation | Type | g/18 L | Type | g/18 L | ESW | ID | ISW | 1st Bake | 2nd Bake |
| P | A2 (Hi-Hi) | 3.66 | B3 | 14.94 | 90 | 100 | 100 | 18.5 | 31.5 |
| D | A3 (Hi-Hi) | 3.79 | B3 | 14.94 | 95 | 100 | 100 | 20.3 | 21.7 |
| B* | A4 (Hi-Hi) | 3.74 | B3 | 14.94 | 90 | 100 | 100 | 21.9 | 32.2 |
| S* | A4 | 3.74 | B1 | 14.94 | 100 | 100 | 100 | 21.9 | 22.9 |
| C | A3 (Lo-Lo) | 2.62 | B3 | 10.37 | 80 | 100 | 100 | 22.5 | 26.0 |
| F | A1 (Hi-Hi) | 3.46 | B3 | 14.94 | 75 | 100 | 100 | 22.8 | 31.2 |
| O | A2 (Lo-Lo) | 2.54 | B3 | 10.37 | 90 | 100 | 100 | 23.6 | 35.9 |
| E | A1 (Lo-Lo) | 2.39 | B3 | 10.37 | 65 | 100 | 90 | 26.4 | 33.0 |
| J* | A6 (Hi-Hi) | 3.37 | B3 | 14.94 | 85 | 100 | 100 | 33.2 | 37.7 |
| A* | A4 (Lo-Lo) | 2.59 | B3 | 10.37 | 85 | 100 | 100 | 34.1 | 36.0 |
| H* | A5 (Hi-Hi) | 4.88 | B3 | 14.94 | 100 | 100 | 100 | 35.9 | 48.1 |
| L* | A7 (Hi-Hi) | 3.72 | B3 | 14.94 | 100 | 100 | 100 | 37.0 | 44.5 |
| T* | NONE | 0 | B1 | 14.94 | 100 | 100 | 100 | 38.0 | 45.5 |
| N* | A8 (Hi-Hi) | 4.27 | B3 | 14.94 | 100 | 100 | 100 | 38.4 | 42.3 |
| I* | A6 (Lo-Lo) | 2.33 | B3 | 10.37 | 100 | 100 | 100 | 42.7 | 46.1 |
| M* | A8 (Lo-Lo) | 2.95 | B3 | 10.37 | 100 | 100 | 100 | 43.1 | 44.7 |
| G* | A5 (Lo-Lo) | 3.38 | B3 | 10.37 | 95 | 100 | 100 | 43.3 | 48.7 |
| R* | NONE | 0 | B3 | 14.94 | 100 | 100 | 100 | 45.2 | 48.7 |
| K* | A7 (Lo-Lo) | 2.58 | B3 | 10.37 | 100 | 100 | 100 | 45.9 | 47.2 |
| Q* | A4 | 3.74 | None | 0 | 40 | 90 | 95 | 50.3 | 52.1 |

*Comparative Example

TABLE 3

| Conversion coated cans | | | | | | | | | |
|---|---|---|---|---|---|---|---|---|---|
| Example 1 | Amount of 5% Surfactant Solution | | Amount of 10% Co-surfactant Solution | | % Water Break Free | | | Slip Angle | |
| Formulation | Type | g/18 L | Type | g/18 L | ESW | ID | ISW | 1st Bake | 2nd Bake |
| D | A3 (Hi-Hi) | 3.79 | B3 | 14.94 | 100 | 100 | 100 | 41.9 | 47.6 |
| P | A2 (Hi-Hi) | 3.66 | B3 | 14.94 | 100 | 100 | 100 | 43.2 | 44.8 |
| F | A1 (Hi-Hi) | 3.46 | B3 | 14.94 | 100 | 100 | 100 | 43.6 | 45.7 |
| S* | A4 | 3.74 | B1 | 14.94 | 100 | 100 | 100 | 45.7 | 43.4 |
| B* | A4 (Hi-Hi) | 3.74 | B3 | 14.94 | 100 | 100 | 100 | 45.7 | 48.2 |
| O | A2 (Lo-Lo) | 2.54 | B3 | 10.37 | 100 | 100 | 100 | 47.3 | 47.1 |
| C | A3 (Lo-Lo) | 2.62 | B3 | 10.37 | 100 | 100 | 100 | 47.9 | 48.5 |
| E | A1 (Lo-Lo) | 2.39 | B3 | 10.37 | 100 | 100 | 100 | 48.4 | 48.9 |
| H* | A5 (Hi-Hi) | 4.88 | B3 | 14.94 | 100 | 100 | 100 | 49.4 | 52.1 |
| G* | A5 (Lo-Lo | 3.38 | B3 | 10.37 | 100 | 100 | 100 | 51.6 | 51.6 |
| J* | A6 (Hi-Hi) | 3.37 | B3 | 14.94 | 100 | 100 | 100 | 51.8 | 52.7 |
| T* | NP-9 only | 0 | B1 | 14.94 | 100 | 100 | 100 | 52.4 | 50.8 |
| A* | A4 (Lo-Lo) | 2.59 | B3 | 10.37 | 100 | 100 | 100 | 52.5 | 50.2 |
| I* | A6 (Lo-Lo) | 2.33 | B3 | 10.37 | 100 | 100 | 100 | 53.4 | 54.0 |
| N* | A8 (Hi-Hi) | 4.27 | B3 | 14.94 | 100 | 100 | 100 | 53.8 | 54.8 |
| L* | A7 (Hi-Hi) | 3.72 | B3 | 14.94 | 100 | 100 | 100 | 54.1 | 53.0 |
| K* | A7 (Lo-Lo) | 2.58 | B3 | 10.37 | 100 | 100 | 100 | 54.7 | 54.6 |
| R* | NONE | 0 | B3 | 14.94 | 100 | 100 | 100 | 55.1 | 51.9 |
| M* | A8 (Lo-Lo) | 2.95 | B3 | 10.37 | 100 | 100 | 100 | 55.3 | 55.7 |
| Q* | A4 | 3.74 | NONE | 0 | 100 | 100 | 100 | 55.7 | 55.2 |

In all cases, pretreatment with Alodine 404 rendered the treated cans completely waterbreak free, however the cans had higher slip angles than those that had not received a conversion coating treatment. Under single bake conditions, the Examples using A1, A2 or A3 as the mobility enhancing surfactant had slip angles less than 0.3% Comparative Formulation S, which had a slip angle of 45.7°. Except for the aforementioned candidates which had good performance that was somewhat reduced after the second bake, most of the double baked AL-404/FRME treated cans had high slip angles that remained nearly the same (high) as they did in the single bake condition. Lower slip angles that may increase on a second bake are preferable to relatively constant, but higher, slip angles, since the double bake test is used to simulate a line stoppage, an irregular occurrence. As seen in Tables 2 and 3, good performance in the combination of mobility enhancement and waterbreak reduction was exhibited by Surfactants A1, A2, and A3 relative to the Comparative Examples.

Dome stain testing of the conversion coated cans was also performed after contacting them with the candidate lubricant and surface conditioner forming compositions. The procedure is described in U.S. Pat. No. 6,040,280 to Kelly et al. Contrary to expectations, applying the surfactant/co-surfactant combinations over the Alodine 404 pretreatment did not result in deterioration of the cans' borax stain resistance or in the uniformity of the muffle color. The treated domes remained uniformly bright silver and their corresponding muffles were uniform and relatively dark brown. It was noted that the Alodine baths used here did not contain any sulfate, the absence of which may have resulted in a more stain resistant coating.

Foam Testing

The foaming properties of the various candidate formulations as recited in Table 4 were determined using a gas sparging method. A fritted glass cylinder was used to disperse nitrogen gas flowing at 0.5 liter per minute into one liter of a solution of the candidate material, as recited in Table 4, contained in a 4 L graduated cylinder, at 86° F. (30° C.). The volume of foam was measured at one-minute intervals until the top graduation was reached, then the nitrogen flow was stopped and the foam head allowed to decay. After ten minutes of decay, another measurement of the foam volume was made. The results of gas sparge testing of combinations of surfactants and co-surfactants are shown in Table 4.

TABLE 4

| Foaming Tests for Example 1 Formulations | | | | | | | | | | | | | | | |
|---|---|---|---|---|---|---|---|---|---|---|---|---|---|---|---|
| | Amount Of 1% Surfactant Solution | | Amount of 10% Cosurfactant Solution | | Foam + Liquid Volume (ml) recorded at each minute after sparging was initiated | | | | | | | | | | Foam + Liquid at 10 minutes Decay |
| | Type | (g/4 L) | Type | (g/4 L) | 1 | 2 | 3 | 4 | 5 | 6 | 7 | 8 | 9 | 10 | Time |
| A* | A4 | 2.88 | B3 | 2.30 | 1950 | 2800 | 3650 | 4000<br>3:25 | | | | | | | 3800 |
| B* | A4 | 4.16 | B3 | 3.32 | 1850 | 2600 | 3350 | 4000<br>3:50 | | | | | | | 3600 |
| C | A3 | 2.91 | B3 | 2.30 | 1850 | 2600 | 3400 | 4000<br>3:50 | | | | | | | 3700 |

TABLE 4-continued

Foaming Tests for Example 1 Formulations

| | Amount Of 1% Surfactant Solution | | Amount of 10% Cosurfactant Solution | | Foam + Liquid Volume (ml) recorded at each minute after sparging was initiated | | | | | | | | | | Foam + Liquid at 10 minutes Decay |
|---|---|---|---|---|---|---|---|---|---|---|---|---|---|---|---|
| | Type | (g/4 L) | Type | (g/4 L) | 1 | 2 | 3 | 4 | 5 | 6 | 7 | 8 | 9 | 10 | Time |
| D | A3 | 4.21 | B3 | 3.32 | 1900 | 2600 | 3400 | 4000 3:50 | | | | | | | 3800 |
| E | A1 | 2.66 | B3 | 2.30 | 1900 | 2650 | 3450 | 4000 3:40 | | | | | | | 3800 |
| F | A1 | 3.84 | B3 | 3.32 | 1950 | 2700 | 3500 | 4000 3:40 | | | | | | | 3800 |
| G* | A5 | 3.76 | B3 | 2.30 | 2000 | 2900 | 3700 | 4000 3:20 | | | | | | | 3450 |
| H* | A5 | 5.43 | B3 | 3.32 | 1950 | 2650 | 3450 | 4000 3:45 | | | | | | | 3100 |
| I | A6 | 2.59 | B3 | 2.30 | 1900 | 2750 | 3550 | 4000 3:30 | | | | | | | 3300 |
| J | A6 | 3.74 | B3 | 3.32 | 2000 | 2700 | 3400 | 4000 3:50 | | | | | | | 2400 |
| K* | A7 | 2.86 | B3 | 2.30 | 1950 | 2750 | 3550 | 4000 3:30 | | | | | | | 3550 |
| L* | A7 | 4.14 | B3 | 3.32 | 1950 | 2700 | 3500 | 4000 3:40 | | | | | | | 3600 |
| M* | A8 | 3.28 | B3 | 2.30 | 2150 | 3200 | 4000 2:45 | | | | | | | | 3650 |
| N* | A8 | 4.74 | B3 | 3.32 | 2050 | 2900 | 3800 | 4000 3:15 | | | | | | | 3750 |
| O | A2 | 2.82 | B3 | 2.30 | 2100 | 3000 | 3900 | 4000 3:05 | | | | | | | 3700 |
| P | A2 | 4.07 | B3 | 3.32 | 2150 | 3050 | 4000 2:55 | | | | | | | | 3800 |
| Q* | A4 | 2.88 | None | 0 | 1600 | 1950 | 1900 | 2150 | 2450 | 2400 | 2400 | 3100 | 3200 | 3200 | 1400 |
| R* | None | 0 | B3 | 2.3 | 1900 | 2750 | 3600 | 4000 3:30 | | | | | | | 3000 |
| S* | A4 | 2.88 | B1 | 2.30 | 1900 | 2450 | 3100 | 3400 | 4000 4:55 | | | | | | 3600 |
| T* | None | 0 | B1 | 2.30 | 1700 | 2200 | 2500 | 2750 | 3000 | 3300 | 3150 | 3100 | | | 1350 |

All of the compositions tested, including the prior art formulations, were quite foamy. The initial foam volume reached 4000 ml for most of the candidates between 3 and 4 minutes. The foam volumes remaining after 10-minutes of decay showed a greater spread of values, but the differences were not very large.

Example 2

A second series of tests were conducted which included some different components and combinations of components. The effect the mobility enhancer to co-surfactant ratio was also investigated. Since A2 was nominally similar to A1, only the latter was used in this work. Candidate lubricant and surface conditioner forming compositions were formulated as recited in Table 5.

TABLE 5

Example 2 Formulations

| EXAMPLE 2 | Amount of 10% Surfactant Solution (g/18 L) | | | | Amount of Co-surfactant Solution (g/18 L) | | |
|---|---|---|---|---|---|---|---|
| FORMULATIONS | A4 | A9 | A1 | A3 | B1 | B4 | B3 |
| 1 | 1.87 | — | — | — | 1.49 | — | — |
| 2 | — | 1.32 | — | — | 1.49 | — | — |
| 3 | — | 1.32 | — | — | — | 1.13 | — |

TABLE 5-continued

Example 2 Formulations

| EXAMPLE 2 | Amount of 10% Surfactant Solution (g/18 L) | | | | Amount of Co-surfactant Solution (g/18 L) | | |
|---|---|---|---|---|---|---|---|
| FORMULATIONS | A4 | A9 | A1 | A3 | B1 | B4 | B3 |
| 4 | — | 1.32 | — | — | — | — | 1.34 |
| 5 | — | — | 1.53 | — | 1.49 | — | — |
| 6 | — | — | 1.53 | — | — | 1.13 | — |
| 7 | — | — | 1.53 | — | — | — | 1.34 |
| 8 | — | — | — | 1.73 | 1.49 | — | — |
| 9 | — | — | — | 1.73 | — | 1.13 | — |
| 10 | — | — | — | 1.73 | — | — | 1.34 |

In Example 2, the FRME process baths were built using the "by-parts" approach whereby the individual raw materials are diluted directly into the process bath. Because of the relatively small quantities of the mobility active and co-surfactant raw materials needed to prepare working baths it was convenient to dilute these raw materials down into an intermediate concentration range before using them to build the process bath. Following this approach, it was discovered that A9 in the range of 1 to 10% gave very cloudy solutions that separated on standing. Even solutions as dilute as 0.1% were cloudy. Formulations containing A9 in combination with either B1 or B3 gave homogenous solutions, which were used to prepare the process baths, but B4 was not able to emulsify A9. A process bath was prepared from the latter mixture by mixing it vigorously using a magnetic stirrer and dispensing the required quantity with out delay.

Commercial grade aluminum cans were treated according to the procedure of Table 1, using the formulations of Table 5 at Step 7 and water at Step 4. No conversion-coated cans were tested. The formulations of Table 5 and the cans coated therewith were tested according to the procedure for Example 1. However, instead of three separate values for waterbreak, in Example 2 overall waterbreak was determined by visually examining the ESW, ISW and ID and estimating percent overall waterbreak free surface.

A new test was performed on the formulations of Table 5 as follows:

Drop Volume Test (Water Carry Out)

The candidate lubricant and surface conditioner forming compositions were tested using the Drop Volume Test, described below, to assess the compositions' effect on the amount of water remaining on cans as the cans enter the drying ovens. The Drop Volume (DV) test was used to estimate the volume of water that would be carried into the dryer on the surfaces of the cans and is considered comparable to and more reproducible than the Water Carry Out (WCO) test of the prior art. To perform the DV test a commercial instrument (Kruss-USA, DVT-10 tensiometer) was adapted to count the number of drops of test solutions issuing from a Teflon capillary at a known flow rate (5 mL/hr). Five replicates of 20 drops each were run and the Drop Volumes measured for each. The average Drop Volume calculated for each formulation based upon the five tests run for each is listed in Table 6 for two different concentrations of each formulation from Table 5.

33°: Formulation 3

23-25°: Formulations 4, 6 and 7

20-23°: Formulations 1 (made according to U.S. Pat. No. 6,040,280), 2, 5, 8, 9, and 10

The average double bake slip angles increased for all of the formulations but based upon confidence intervals the increase over the single bake angle was significant only for the following formulations: 1, 3, 5, 6 and 9. Formulations 3, 6 and 9 using B4 co-surfactant all had higher single bake slip angles and/or suffered greater increases in slip angle on a second baking. With B1 co-surfactant, the single and double bake slip angles were low. In the B3 co-surfactant mixtures, A3 gave slip angles about 5° lower than those observed for the formulations containing A9 or A1.

Foaming

With the exception of Formulation 7, all of the candidate formulations more or less matched the rapid foam build profile of Formulation 1. The foams from Formulations 1, 2, 5, and 8, all containing co-surfactant B1, were the longest lived and showed no tendency to decay in the allotted 10-min. decay period. Formulations 3, 4, and particularly 7 showed the most rapid decay rates. All Example 2 formulations, except Formulation 7, were very foamy.

Drop Volume

Formulations 1-10 were tested at a fixed flow rate of 2.5 mL/hr at a mobility active concentration corresponding to a 0.26% solution of Formulation 1. Compared to the result with pure deionized water, the use of any of the candidate FRMEs caused the average drop volume to decrease by about 48%. The drop volumes of the candidate formulations were all in the range of 13-15 μL/drop and appeared to decrease in the

TABLE 6

Example 2 Formulations Test Results

| EXAMPLE 2 FORMULA | Concentrate Appearance | Overall Waterbreak Free | Slip Angle 1st-Bake | Slip Angle 2nd-Bake | Initial Foam Volume 3 min. | Initial Foam Volume 5 min. | Foam & Liquid at 10 Min. Decay Time | Drop Volume at 0.26% | Drop Volume at 0.13% |
|---|---|---|---|---|---|---|---|---|---|
| 8 | Clear | 100 | 20.3 | 21.0 | 2550 | 3550 | 4000 | 14.203 | 16.099 |
| 10 | Clear | 100 | 19.6 | 21.5 | 2500 | 3500 | 3700 | 13.919 | 16.180 |
| 1 | Clear | 100 | 19.6 | 21.7 | 2550 | 3500 | 4000 | 13.984 | 16.667 |
| 5 | Clear | 100 | 19.9 | 22.5 | 2600 | 3600 | 4000 | 14.207 | 16.840 |
| 7 | Clear | 95 | 25.1 | 25.3 | 2500 | 2700 | 1750 | 13.952 | 16.367 |
| 2 | Clear | 90 | 20.8 | 21.7 | 2500 | 3500 | 4000 | 14.374 | 16.769 |
| 9 | Clear | 80 | 22.6 | 26.7 | 2500 | 3500 | 3650 | 13.478 | 16.278 |
| 6 | Clear | 75 | 24.0 | 28.5 | 2550 | 3500 | 3600 | 13.506 | 16.969 |
| 3 | Very cloudy | 75 | 32.5 | 36.8 | 2500 | 3350 | 2250 | 13.728 | 17.367 |
| 4 | Clear | 60 | 23.8 | 24.6 | 2550 | 3500 | 3000 | 14.075 | 17.138 |
| Distilled Water | — | Not Run | — | — | — | — | — | 25.746 | 25.121 |

Waterbreak Results

At molar concentrations of mobility active equivalent to that found in a 0.26% solution of Formulation 1, there were only four formulations that gave completely waterbreak free surfaces in a Carousel Can Washer. All of the other formulations gave %-Waterbreak free results between 95 and 60%. These were:

100%-WBF: 1, 5, 8, 10

90-95% WBF: 2, 7

60-90% WBF: 3, 4, 6, 9

The incidence of waterbreak seemed to be worse when either or both A9 or B4 were present in the formulation.

Slip Angles.

The average single bake slip angles appeared to fall into three categories:

co-surfactant order: B4<B3<B1. At this concentration, the nature of the mobility active surfactant did not appear to have a strong influence on the drop volumes observed. The measurements were repeated at ½-the molar mobility active concentration (equivalent to 0.13% Formulation 1) in an attempt to amplify the differences between the FRMEs. As expected, the volumes of the drops were greater than they were at the higher concentration and in the range of 16-18 μL/drop or 68% that of deionized water. At this concentration, Formulation 1 had a drop volume of 16.7 μL. Similarly to the results obtained at a higher concentration, the variability in the repeated measurements of each formulation was quite small. For the lower concentration, the drop volume trend with changes in the co-surfactant was not uniform except that with B4 the drop volumes were now slightly higher than with B1 or B3. The trend with changes in the mobility surfactant was for the drop volume to vary slightly in the order: A3<A1<A9.

Example 3

A third series of tests were conducted which included some different components and combinations of components. Candidate lubricant and surface conditioner forming compositions were formulated as recited in Table 7.

TABLE 7

Example 3 Formulations

| Example 3 | Amount of 10% Surfactant Solution (g/18 L) | | | | | Amount of Co-surfactant Solution (g/18 L) | |
|---|---|---|---|---|---|---|---|
| Formulations | A4 | A1 | A3 | A6 | A10 | B1 | B3 |
| A | 1.87 | 0 | 0 | 0 | 0 | 1.49 | 0 |
| B | 0 | 1.53 | 0 | 0 | 0 | 0 | 1.34 |
| C | 0 | 0 | 1.73 | 0 | 0 | 0 | 1.34 |
| D | 0 | 0 | 0 | 1.25 | 0 | 0 | 1.34 |
| E | 0 | 0 | 0 | 1.87 | 0 | 0 | 1.34 |
| F | 0 | 0 | 0 | 1.25 | 0 | 1.49 | 0 |
| G | 0 | 0 | 0 | 1.87 | 0 | 1.49 | 0 |
| H | 0 | 0 | 0 | 0 | 1.90 | 0 | 1.34 |
| I | 0 | 0 | 0 | 0 | 2.85 | 0 | 1.34 |
| J | 0 | 0 | 0 | 0 | 1.90 | 1.49 | 0 |
| K | 0 | 0 | 0 | 0 | 2.85 | 1.49 | 0 |

In Example 3, the FRME process baths were built using the "by-parts" approach whereby the individual raw materials are diluted directly into the process bath.

Commercial grade aluminum cans were treated according to the procedure of Table 1, using the formulations of Table 7 at Step 7 and water at Step 4. The cans were tested according to the procedure for Example 2 for waterbreak and slip angle performance, which results are shown in the table below:

TABLE 8

Example 3 Formulations Test Results

| Example 3 Formulations | Overall Waterbreak Free | Slip Angle 1st-Bake | Slip Angle 2nd-Bake |
|---|---|---|---|
| A | 100 | 25.1 | 42.3 |
| K | 100 | 26.6 | 35.5 |
| J | 100 | 27.4 | 35.5 |
| I | 100 | 29.6 | 45.0 |
| G | 100 | 37.2 | 42.2 |

TABLE 8-continued

Example 3 Formulations Test Results

| Example 3 Formulations | Overall Waterbreak Free | Slip Angle 1st-Bake | Slip Angle 2nd-Bake |
|---|---|---|---|
| F | 100 | 39.2 | 45.3 |
| H | 100 | 39.5 | 46.6 |
| C | 90 | 26.3 | 51.2 |
| D | 90 | 43.3 | 51.2 |
| E | 80 | 42.6 | 49.6 |
| B | 75 | 30.9 | 48.7 |

At the selected concentrations, results for B and C were not consistent with results for similar formulations from Example 2. The experiment was concluded and additional testing of the formulations providing anomalous results was initiated in Example 4.

Example 4

A fourth series of tests were conducted which included some different components and combinations of components. Candidate lubricant and surface conditioner forming compositions were formulated, based on activity calculated as shown in Table 10, with amounts as recited in Table 9.

TABLE 9

Example 4 Formulations

| Example 4 Formulations | Mobility Surfactant | | Co-surfactant | |
|---|---|---|---|---|
| | Type | Amount of 1% w/w solution (g/9 L) | Type | Amount of 10% w/w solution (g/9 L) |
| Cleaned Only | — | — | — | — |
| A | A4 | 9.37 | B1 | 7.47 |
| B | A1 | 7.64 | B3 | 6.70 |
| C | A3 | 8.63 | B3 | 6.70 |
| D | A7 | 8.96 | B3 | 6.70 |
| E | A11 | 8.48 | B3 | 6.70 |
| F | A12 | 9.27 | B3 | 6.70 |
| G | A5 | 12.11 | B3 | 6.70 |
| H | A3 | 8.63 | B2 | 13.92 |
| BB | A1 | 7.64 | B3 | 9.95 |
| CC | A3 | 8.63 | B3 | 9.95 |
| DD | A7 | 8.96 | B3 | 9.95 |
| EE | A11 | 8.48 | B3 | 9.95 |
| FF | A12 | 9.27 | B3 | 9.95 |
| GG | A5 | 12.11 | B3 | 9.95 |
| HH | A3 | 8.63 | B2 | 20.69 |
| HHH | A3 | 8.63 | B2 | 7.16 |

TABLE 10

Molar concentration and activity calculation for Table 9 amounts

| | | | Basis, L == 9.00 | | | | | | |
|---|---|---|---|---|---|---|---|---|---|
| | ME (Mobility Surf.) | Co-Surf. | MW-Mobility Surfactant | MW Co-surf. | μmol/L ME | μmol/L Co-surf. | ME Activity | Qty. ME/basis | Qty. Co-Surf./basis |
| A: A4/B1 | A4 | B1 | 749.95 | 616.79 | 12.50 | 134.60 | 90.00 | 0.0937 | 0.7472 |
| B: A1/B3 | A1 | B3 | 678.90 | 552.75 | 12.50 | 134.60 | 100.00 | 0.0764 | 0.6696 |
| BB: A1/B3 | A1 | B3 | 678.90 | 552.75 | 12.50 | 200.00 | 100.00 | 0.0764 | 0.9950 |
| C: A3/B3 | A3 | B3 | 767.00 | 552.75 | 12.50 | 134.60 | 100.00 | 0.0863 | 0.6696 |

TABLE 10-continued

Molar concentration and activity calculation for Table 9 amounts

| | | | Basis, L == 9.00 | | | | | | |
|---|---|---|---|---|---|---|---|---|---|
| | ME (Mobility Surf.) | Co-Surf. | MW-Mobility Surfactant | MW Co-surf. | μmol/L ME | μmol/L Co-surf. | ME Activity | Qty. ME/basis | Qty. Co-Surf./basis |
| CC: A3/B3 | A3 | B3 | 767.00 | 552.75 | 12.50 | 200.00 | 100.00 | 0.0863 | 0.9950 |
| D: A7/B3 | A7 | B3 | 684.86 | 552.75 | 12.50 | 134.60 | 86.00 | 0.0896 | 0.6696 |
| DD: A7/B3 | A7 | B3 | 684.86 | 552.75 | 12.50 | 200.00 | 86.00 | 0.0896 | 0.9950 |
| E: A11/B3 | A11 | B3 | 666.89 | 552.75 | 12.50 | 134.60 | 88.50 | 0.0848 | 0.6696 |
| EE: A11/B3 | A11 | B3 | 666.89 | 552.75 | 12.50 | 200.00 | 88.50 | 0.0848 | 0.9950 |
| F: A12/B3 | A12 | B3 | 732.97 | 552.75 | 12.50 | 134.60 | 89.00 | 0.0927 | 0.6696 |
| FF: A12/B3 | A12 | B3 | 732.97 | 552.75 | 12.50 | 200.00 | 89.00 | 0.0927 | 0.9950 |
| G: A5/B3 | A5 | B3 | 742.94 | 552.75 | 12.50 | 134.60 | 69.00 | 0.1211 | 0.6696 |
| GG: A5/B3 | A5 | B3 | 742.94 | 552.75 | 12.50 | 200.00 | 69.00 | 0.1211 | 0.9950 |
| H: A3/B2 | A3 | B2 | 767.00 | 1149.47 | 12.50 | 134.60 | 100.00 | 0.0863 | 1.3925 |
| HH: A3/B2 | A3 | B2 | 767.00 | 1149.47 | 12.50 | 200.00 | 100.00 | 0.0863 | 2.0690 |
| HHH: A3/B2 | A3 | B2 | 767.00 | 1149.47 | 12.50 | 69.20 | 100.00 | 0.0863 | 0.7159 |

In Example 4, the FRME process baths were built up using a "by parts" method, dispensing the required quantities of raw materials directly into the bath in the form of 1% solutions. The formulations used here are identified with a single or double alphabetic character. Single characters correspond to the formulations that were 135 μM in co-surfactant while the double character formulations contained co-surfactant at 200 μM. Formulation A was made according to U.S. Pat. No. 6,040,280. Formulation HHH was a special one that was 65 μM in co-surfactant B2. With the exception of A7, which gave a cloudy solution, all of the 1%, stock solutions were clear and homogeneous.

Commercial grade aluminum cans were treated according to the procedure of Table 1, using the formulations of Table 9 at Step 7 and water at Step 4. The coated cans and the formulations of Table 9 were tested according to the procedure for Example 2, with results displayed in Table 11 below:

TABLE 11

Example 4 Formulations Test Results

| Example 4 Formulations | Slip Angle 1st-Bake | Slip Angle 2nd-Bake | Initial Foam Volume 3 min. | Foam & Liquid at 10 Min. Decay Time | Drop Volume at 0.26% | % Overall- WBF |
|---|---|---|---|---|---|---|
| Cleaned Only | 54.1 | | | | 24.989 | 100 |
| A: A4/B1 | 25.3 | 33.4 | 3700 | 3950 | 14.439 | 100 |
| B: A1/B3 | 30.6 | 34.3 | 3750 | 3600 | 14.002 | 80 |
| BB: A1/B3 | 26.6 | 32.8 | 3850 | 3800 | 12.720 | 100 |
| C: A3/B3 | 29.8 | 37.9 | 3550 | 3800 | 14.007 | 90 |
| CC: A3/B3 | 27.7 | 33.6 | 3750 | 3850 | 12.863 | 95 |
| D: A7/B3 | 29.6 | 36.1 | 3450 | 3300 | 13.861 | 30 |
| DD: A7/B3 | 25.4 | 28.7 | 3850 | 3400 | 12.577 | 35 |
| E: A11/B3 | 28.1 | 34.7 | 3750 | 3700 | 13.902 | 80 |
| EE: A11/B3 | 30.4 | 40.0 | 3850 | 3800 | 12.600 | 90 |
| F: A12/B3 | 28.3 | 34.4 | 3650 | 3800 | 14.035 | 95 |
| FF: A12/B3 | 24.7 | 31.4 | 3800 | 3800 | 12.654 | 95 |
| G: A5/B3 | 40.6 | 45.9 | 3800 | 2750 | 13.623 | 100 |
| GG: A5/B3 | 29.9 | 37.7 | 3750 | 3550 | 12.418 | 100 |
| H: A3/B2 | 24.2 | 26.1 | 3800 | 3900 | 17.118 | 100 |
| HH: A3/B2 | 22.6 | 30.3 | 3800 | 3950 | 16.491 | 100 |
| HHH: A3/B2 | 22.3 | 34.9 | 3800 | 3900 | 18.180 | 95 |

Single Bake Slip Angles:

All of the mobility surfactants were run at a fixed concentration of 12.5 μM. The B3 co-surfactant was run at concentrations of 135 and 200 μM. Three special formulations built on A3 and containing B2 as the co-surfactant were run with the latter at 65, 135 and 200 μM.

Formulation A, a benchmark made according to U.S. Pat. No. 6,040,280, had a single bake Slip Angle of about 25°. The Slip Angles of the candidate mobility surfactants ranged from a low of about 22° for Formulations HH and HHH to about 41° for Formulation G. Despite it's apparent structural similarity to A4, A5 was not as effective for reducing the can's Slip Angles.

Most of the candidate mixtures containing the higher concentration of co-surfactant gave lower Slip Angles than they did at the lower concentration. The exceptions were Formulations C/CC containing A3 and B3 and Formulations E/EE containing A11 where the average Slip Angles were contained within the 95% confidence interval for the measurements.

Second Bake Slip Angles:

This measurement was made after the normal Single Bake Slip Angle measurements had been performed by re-baking the cans for an additional 5 min. at 150° C. The purpose of this test was to determine how resistant the candidate ether carboxylates might be to baking off or decomposing during line stops in the washer oven. In each case the 2nd bake caused the Slip Angle to increase by 3-7° or up to 12° in the case of the A3/low B3 formulation.

Waterbreak:

Cans treated with Formulation A in the field or on the Beltwasher usually are not completely waterbreak free. In this experiment, which was performed in the Carousel washer, the Formulation A control cans were 100% waterbreak free (WBF). In a few cases, the co-surfactant concentration seemed to affect the %-WBF result but the effect did not appear to be very consistent or very large. The largest change with co-surfactant concentration was seen for the A1 Formulations B and BB which were 80 and 100% WBF respectively.

Formulations D and DD containing A7 had the poorest performance, producing cans that were only about 30% WBF. Except for these formulations and the low co-surfactant Formulations B and E, which were about 80% WBF, the majority of the formulations were 90+% WBF.

Drop Volume Measurements:

The average volume per drop of each candidate process bath was determined in an attempt to discern differences between them that might be correlated with the solution's drainage characteristics.

Without exception, increasing the co-surfactant concentration of a given solution resulted in a substantial decrease in its Drop Volume. The Drop Volumes observed fell roughly into four categories:

25 μL/drop—characteristic of deionized water itself 16-18 μL/drop—characteristic of the A3/B2 formulations 14-15 μL/drop—low B3 formulations and the control, Formulation A 12-13 μL/drop—high B3 formulations Formulation A, the control solution, had a greater Drop Volume than any of the low B3 formulations even though it was equimolar in co-surfactant using B1. Drop Volume results from the A3 mixtures containing B2, were less than those from DI water, but were not as small as those obtained from any of the other mixtures. The larger Drop Volumes suggested that their drainage characteristics are inferior to solutions containing B3.

Initial and Persistent Foam Volume (IFV, PFV):

All of the candidate FRME mixtures were relatively foamy with short rise times and long decay times. After sparging for 3 min., many of the candidates had a higher IFV than Formulation A. The differences however were not great and all of them, Formulation A included, reached the maximum measurable foam volume between 3 and 4 minutes.

Most of the candidate FRMEs had slightly lower amounts of persistent foam than Formulation A with Formulations D and DD and especially G showing the most effective defoaming.

Six formulations were found to have Slip Angle, tensiometric and waterbreak performance that was nearly identical to, or superior to Formulation A, a benchmark made according to U.S. Pat. No. 6,040,280. All but one of these formulations contained a greater amount of co-surfactant than Formulation A (200 vs. 134 μMol/L). The three best candidate formulations were: CC, BB and FF.

Although they were superior to most of the candidate formulations in terms of their slip and waterbreak performance, the A3 mixtures containing B2 as the co-surfactant did not perform as well in reducing the Drop Volume.

Example 5

A fifth series of tests were conducted to make concentrates of candidate lubricant and surface conditioner forming compositions. Candidate lubricant and surface conditioner forming compositions were formulated as recited in Table 12.

TABLE 12

Example 5 Formulations

| Example 5 Formulations (g/l) | A: 8/1 | B: 10/1 | C: 9/1 | D: 8/1 | E: 7/1 | F: 6/1 |
|---|---|---|---|---|---|---|
| A4 | 4.00 | — | — | — | — | — |
| A3 | 0.00 | 4.00 | 4.00 | 4.00 | 4.00 | 4.00 |
| B1 | 32.00 | 40.00 | 36.00 | 32.00 | 28.00 | 24.00 |

Formulations of Example 5 were added to processing baths to achieve the concentrations of FRME recited in Table 13. Commercial grade aluminum cans were treated according to the procedure of Table 1, using the formulations of Table 12 at Step 7 and water at Step 4. The coated cans and the formulations of Table 12 were tested according to the procedure for Example 2, with the exception of the foam test. The foam test for Example 5 was the Single Can Washer (SCW) test. Generally, foam heights are more convenient to measure in the gas sparge method, which is the test of choice for large numbers of samples. While less convenient for measuring foam, the SCW method is believed to provide the advantage of reproducing on a small scale the mechanics of foam generation and decay found in commercial washers.

Single Can Washer Foam Test

The foam rise characteristics of the various lubricant and surface conditioner forming composition formulations were determined according to the following procedure: 0.2% solutions of the candidates were sprayed at 5 psi and 86° F. in a selected single can washer (SCW) while noting the times required for the foam to rise to (1) the tanks inner gunwale (time to gunwale or TTG) and (2) 5 cm above the gunwale (G+5). By these criteria, a larger result is indicative of a slower rate of foam rise and is more desirable. The test results for the Example 5 formulations are displayed in Table 13 below.

TABLE 13

Example 5 Formulations Test Results

| Example 5 Formulations (% w/w) | % WBF ESW | Slip Angle 1st Bake | Slip Angle 2nd Bake | Avg. DV | Time to foam to top of Gunwale | Time to Gunwale + 5 cm | PFV, 2-min decay | PFV 5-min. decay | PFV 10-min. decay |
|---|---|---|---|---|---|---|---|---|---|
| D: 8/1 - 0.25 | 100 | 20.67 | 23.24 | 14.434 | 2.3 | 4.0 | 14.5 | 14.0 | 13.0 |
| E: 7/1 - 0.25 | 100 | 20.94 | 22.83 | 14.915 | 1.4 | 2.3 | 15.0 | 14.5 | 12.5 |
| B: 10/1 - 0.25 | 100 | 21.24 | 24.74 | 13.842 | 1.4 | 2.3 | 15.0 | 14.0 | 13.5 |
| C: 9/1 - 0.25 | 100 | 21.56 | 23.45 | 14.076 | 1.3 | 2.2 | 14.5 | 14.5 | 13.5 |
| A: 8/1 - 0.25 | 100 | 22.47 | 24.17 | 14.258 | 1.3 | 2.1 | 14.5 | 13.5 | 12.0 |
| B: 10/1 - 0.19 | 100 | 22.88 | 25.87 | 14.525 | 1.3 | 2.3 | 14.5 | 14.0 | 13.5 |
| F: 6/1 - 0.25 | 100 | 22.89 | 24.61 | 15.508 | 1.4 | 2.3 | 14.5 | 14.5 | 13.0 |
| C: 9/1 - 0.19 | 100 | 25.45 | 30.40 | 14.956 | 1.4 | 2.3 | 15.0 | 14.0 | 12.5 |
| D: 8/1 - 0.19 | 100 | 26.02 | 28.57 | 15.263 | 1.3 | 2.3 | 14.5 | 14.5 | 13.5 |
| B: 10/1 - 0.13 | 100 | 28.17 | 36.03 | 16.022 | 1.4 | 2.3 | 15.0 | 14.0 | 13.5 |
| E: 7/1 - 0.19 | 95 | 22.99 | 29.92 | 15.699 | 1.4 | 2.4 | 15.0 | 14.5 | 13.5 |
| A: 8/1 - 0.19 | 95 | 25.37 | 28.35 | 15.175 | 1.3 | 2.3 | 15.0 | 14.5 | 13.0 |
| C: 9/1 - 0.13 | 95 | 31.23 | 34.89 | 16.495 | 1.5 | 2.4 | 14.5 | 14.0 | 13.5 |
| A: 8/1 - 0.13 | 90 | 34.19 | 41.33 | 17.100 | 1.5 | 2.4 | 14.5 | 14.0 | 12.5 |
| F: 6/1 - 0.19 | 85 | 33.61 | 40.47 | 16.509 | 1.4 | 2.3 | 15.0 | 14.5 | 14.0 |
| D: 8/1 - 0.13 | 85 | 35.45 | 41.97 | 17.090 | 1.4 | 2.5 | 15.0 | 14.5 | 14.0 |
| E: 7/1 - 0.13 | 80 | 24.59 | 25.79 | 17.506 | 1.6 | 2.8 | 14.5 | 13.0 | 12.0 |
| F: 6/1 - 0.13 | 70 | 33.79 | 38.49 | 18.566 | 1.6 | 2.8 | 15.0 | 14.5 | 13.5 |

Results in the above Table 13 are sorted by % WBF, then Slip Angle for 1$^{st}$ Bake and then for Avg. DV. Formulation A was made according to U.S. Pat. No. 6,040,280. For a given concentration of FRME, the A3 containing formulations provide a better overall performance than Formulation A. Comparing similar concentrations, nearly all of the candidate formulations produced slip angles equal to or less than Formulation A. In this comparison, formulation F at 0.19% stood out by having an unusually high slip angle. Formulation B with the highest co-surfactant/mobility surfactant ratio was the only composition, including Formulation A, that was totally waterbreak free at all of the concentrations tested here. All of the others showed some degree of waterbreak especially at their lower concentrations and at lower co-surfactant/mobility surfactant ratios. Even with its waterbreak, Formulation C (9:1) produced less waterbreak than Formulation A.

Candidate lubricant and surface conditioner forming compositions A and C from Table 12 were added to processing baths to achieve the concentrations of FRME recited in Table 14. Commercial grade aluminum cans were treated according to the procedure recited in Table 1, using the formulations of Table 14 at Step 7 and water at Step 4.

TABLE 14

Test Results for Example 5
Formulations A versus C for Non-conversion Coated Cans

| | ME (% w/w) | B1 (g/18 L) | % WBF ESW | % WBF ID | % WBF ISW | Slip Angle 1st Bake | Slip Angle 2nd Bake | Avg. DV | Time to foam to top of GW | Time to GW + 5 cm | PFV, 2-min decay | PFV 5-min. decay | PFV 10-min. decay |
|---|---|---|---|---|---|---|---|---|---|---|---|---|---|
| Cleaned only | 0 | 0 | 100 | 100 | 100 | 52.8 | 54.3 | 24.77 | | | | | |
| A - 0.0625 | 0.065 | 11.70 | 85 | 100 | 100 | 45.6 | 48.5 | 20.96 | 2.3 | 9.8 | −4 | −4 | −1 |
| C: - 0.0625 | 0.065 | 11.70 | 80 | 100 | 100 | 46.3 | 48.4 | 20.65 | 1.8 | 2.7 | −4.5 | −3.5 | −3 |
| A - 0.0975 | 0.0975 | 17.55 | 85 | 100 | 100 | 43.3 | 48.9 | 18.66 | 1.8 | 2.8 | −4 | −3.5 | −2.5 |
| C: - 0.0975 | 0.0975 | 17.55 | 80 | 100 | 100 | 42.6 | 45.7 | 18.16 | 1.6 | 2.4 | −4.5 | −3.5 | −3 |
| A - 0.13 | 0.13 | 23.40 | 80 | 100 | 100 | 36.0 | 46.3 | 16.99 | 1.5 | 2.3 | −3.5 | −3 | −2 |
| C: - 0.13 | 0.13 | 23.40 | 95 | 100 | 100 | 35.9 | 41.0 | 16.64 | 1.5 | 2.3 | −4 | −4 | −3 |
| A - 0.16 | 0.16 | 28.80 | 95 | 100 | 100 | 27.4 | 43.4 | 15.95 | 1.3 | 2.2 | −4 | −4 | −2.5 |
| C: - 0.16 | 0.16 | 28.80 | 100 | 100 | 100 | 28.7 | 37.6 | 15.82 | 1.5 | 2.5 | −4.5 | −4 | −4 |
| A - 0.19 | 0.19 | 34.20 | 95 | 100 | 100 | 32.8 | 38.1 | 15.37 | 1.3 | 2.3 | −4 | −3.5 | −3 |
| C: - 0.19 | 0.19 | 34.20 | 100 | 100 | 100 | 25.5 | 31.3 | 15.13 | 1.3 | 2.5 | −4.5 | −4.5 | −3.5 |
| A - 0.22 | 0.22 | 39.60 | 100 | 100 | 100 | 26.7 | 34.7 | 14.89 | 1.4 | 2.2 | −4 | −3.5 | −3 |
| C: - 0.22 | 0.22 | 39.60 | 100 | 100 | 100 | 29.6 | 41.0 | 14.72 | 1.3 | 2.0 | −4 | −3 | −3 |

The single bake slip angles show that most of the C formulations applied to non-Alodine treated cans performed about as well A formulations at the same concentration. The use of a second bake to simulate a line stoppage in the washer oven caused the measured slip angles to suffer a median increase of about 4. In some examples a greater increase was seen, e.g. 16° with 0.16% A. In four out of six cases, the second bake slip angles on non-Alodine treated cans were found to be lower following application of C formulations compared to cans treated with the same concentration of A formulation.

The foaming characteristics of the Formulation A and C were determined by spraying their dilute solutions at several concentrations in a Single Can Washer and noting the time at which the foam front crossed the horizontal line defined by the spray tank's gunwale (i.e. the horizontal top edge of the spray tank) and the time it took the foam front to rise 5 cm above the gunwale. These times will be referred to as T1 and T2 respectively. By these measures, a longer cross over time equates to a less foamy formulation and vice versa. Almost all of the formulations had about the same, short, T1 and T2 times and there seemed to be no strong dependence on the nature of the FRME or its concentration.

The addition of either Formulation A or C caused the Drop Volume to decrease to about 21 μL at 0.065%. Increasing the concentration of the composition caused further decreases in the Drop Volume to around 14.8 μL. Formulations of C produced smaller drops than the corresponding concentrations of Formulation A. On this basis Formulation C compositions appear to have better water drainage properties compared to Formulation A.

TABLE 15

Test Results for Example 5 Formulations A versus C for Conversion Coated Cans

| | ME (% w/w) | B1 (g/18 L) | % WBF ESW | % WBF ID | % WBF ISW | Slip Angle 1st Bake | Slip Angle 2nd Bake |
|---|---|---|---|---|---|---|---|
| Cleaned only - 0 - AL | 0 | 0 | 100 | 100 | 100 | 55.6 | 56.1 |
| A: - 0.0625 - AL | 0.065 | 11.70 | 100 | 100 | 100 | 54.4 | 51.2 |
| C: - 0.0625 - AL | 0.065 | 11.70 | 100 | 100 | 100 | 50.2 | 49.4 |
| A: - 0.0975 - AL | 0.0975 | 17.55 | 100 | 100 | 100 | 49.9 | 50.2 |
| C: - 0.0975 - AL | 0.0975 | 17.55 | 100 | 100 | 100 | 51.1 | 51.4 |
| A: - 0.13 - AL | 0.13 | 23.40 | 100 | 100 | 100 | 50.1 | 50.5 |
| C: - 0.13 - AL | 0.13 | 23.40 | 100 | 100 | 100 | 45.8 | 48.1 |
| A: - 0.16 - AI | 0.16 | 28.80 | 100 | 100 | 100 | 44.9 | 45.6 |
| C: - 0.16 - AL | 0.16 | 28.80 | 100 | 100 | 100 | 41.6 | 46.2 |
| A: - 0.19 - AL | 0.19 | 34.20 | 100 | 100 | 100 | 41.5 | 44.3 |
| C: - 0.19 - AL | 0.19 | 34.20 | 100 | 100 | 100 | 37.9 | 46.9 |
| A: - 0.22 - AL | 0.22 | 39.60 | 100 | 100 | 100 | 32.7 | 39.8 |
| C: - 0.22 - AL | 0.22 | 39.60 | 100 | 100 | 100 | 35.3 | 40.6 |

For conversion coated and non-conversion coated cans, in general, the slip angle tended to decrease as the FRME concentration increased. The application of an Alodine 404 conversion coating prior to application of the FRME solutions resulted in an increase in the slip angle of the FRME in test. In four out of six cases, the single bake slip angles on Alodine treated cans were found to be 3-4° lower following application of C formulations compared to cans treated with the same concentration of A formulation. The differences in double bake performance between Formulations of A and of C on AL-404 treated surfaces were not significant.

All of the cans treated with AL-404 were 100% waterbreak free regardless of the concentration of FRME in test. The Interior Sidewalls and Domes were uniformly waterbreak free for all samples. Greater variations in the % WBF results were seen on the Exterior Sidewalls of untreated cans. At the lowest concentrations used, 0.0625 and 0.0975%, the Formulation C treated cans were 80% WBF compared to the Formulation A cans which were slightly better at 85%. At a concentration 0.13%, the Formulation C began to outperform Formulation A (95% vs. 80%); Formulation A continued to lag in performance at concentrations of 0.16 and 0.19%. At the highest concentration of 0.22% both the Formulation A and C treated cans were 100% WBF.

The invention claimed is:

1. A liquid concentrate suitable for mixing with water to produce a liquid lubricant and surface conditioner forming composition, said concentrate comprising water and:

(A) an amount of a component selected from the group consisting of molecules of oxa acids and their methyl esters and mixtures thereof corresponding to general formula (I):

$$H_3C—(CH_2)_n—CH=CH—(CH_2)_m—O—(CH_2CH_2O)_x—CH_2—C(=O)—OR \quad (I)$$

where each of m, n and x, which may be the same or different, is a positive integer, x is not less than 2, and R represents H or $CH_3$; and (B) an amount of a component selected from the group consisting of:

(B.1) molecules conforming to general formula (II):

$$R_1O(CH_2CH_2O)_y(CH_2CHCH_3O)_zH \quad (II),$$

where $R_1$ is a moiety selected from the group consisting of (i) saturated and unsaturated straight and branched chain aliphatic monovalent hydrocarbon moieties and (ii) saturated and unsaturated straight and branched chain aliphatic monovalent hydrocarbon moiety substituent bearing phenyl moieties in which the aromatic ring in the phenyl moiety is directly bonded to the oxygen atom appearing immediately after the $R_1$ symbol in formula (II); y is a positive integer, and z is zero to 20;

(B.2) molecules conforming to general formula (III):

$$R_2C(O)O(CH_2CH_2O)_pH \quad (III)$$

where $R_2$ is selected from the group consisting of saturated and unsaturated straight and branched chain aliphatic monovalent hydrocarbon moieties and p is a positive integer;

(B.3) molecules conforming to general formula (IV):

$$HO(CH_2CH_2O)_q(CH_2CHCH_3O)_r(CH_2CH_2O)_{q'}H \quad (IV),$$

where each of q and q', which may be the same or different, represents a positive integer from 2 to 10 and r represents a positive integer from 3 to 60;

(B.4) molecules conforming to general formula (V):

$$HO(CH_2CHCH_3O)_s(CH_2CH_2O)_t(CH_2CHCH_3O)_{s'}H \quad (V)$$

where each of s and s', which may be the same or different, represents a positive integer from 10 to 63 and t represents a positive integer from 2 to 20;

and mixtures thereof;

wherein the amount of component (B) has a ratio to the amount of component (A) that is from about 5.0:1.0 to about 20:1.0.

2. A concentrate according to claim 1, where: m and n are, each independently, from 3-18; x is from 2 to 25; each of $R_1$ and $R_2$ independently contains from 8 to 22 carbon atoms; y is 2 to 26; each of q and q' is from 2 to 9; r is from 5 to 45; each of s and s' is from 15 to 55; t is from 3 to 18; and the ratio of the amount of component (B) to the amount of component (A) is from about 5.5:1.0 to about 19:1.0.

3. A concentrate according to claim 2, where: m and n are, each independently, from 4 to 16; x is from 3 to 22; each of $R_1$ and $R_2$ contains from 9 to 21 carbon atoms; y is 3 to 25; each of q and q' is from 3 to 9; r is from 8 to 41; each: of s and s' is from 20 to 48; t is from 4 to 16; and the ratio of the amount of component (B) to the amount of component (A) is from about 6.0:1.0 to about 18.0:1.0.

4. A concentrate according to claim 3, where: m and n are, each independently, from 5 to 14; x is from 4 to 20; each of $R_1$ and $R_2$ contains from 10 to 20 carbon atoms; y is 4 to 24; each of q and q' is from 3 to 8; r is from 8 to 41; each of s and s' is from 20 to 48; t is from 4 to 16; and the ratio of the amount or component (B) to the amount of component (A) is from about 6.5:1.0 to about 17.0:1.0.

5. A concentrate according to claim 4, where: m and n are, each independently, from 6 to 12; x is from 5 to 18; each of $R_1$ and $R_2$ contains from 9 to 19 carbon atoms; y is 5 to 23 each of q and q' is from 3 to 7; r is from 16 to 36; each of s and s' is from 22 to 42; t is from 5 to 14; and the ratio of the amount of component (B) to the amount of component (A) is from about 7.0:1.0 to about 16:1.0.

6. A concentrate according to claim 5, where: m and n are, each independently, from 7 to 11; x is from 6 to 15; y is 6 to 22; each of q and q' is from 3 to 8; r is from 20 to 34; each of s and s' is from 22 to 37; t is from 5 to 12; and the ratio of the amount of component (B) to the amount of component (A) is from about 7.5:1.0 to about 15:1.0.

7. A concentrate according to claim 1, wherein m and n are, each independently, from 4 to 14, x is from 4 to 14; $R_1$ and $R_2$ each independently has from 10 to 20 carbon atoms; $R_1$ is selected from saturated and unsaturated straight and branched chain aliphatic monovalent hydrocarbon moieties; each of q and q' is from 3 to 5; r is from 24 to 34; each of s and s' is from 24 to 33; t is from 5 to 10; and the ratio of the amount of component (B) to the amount of component (A) is from about 6.0:1.0 to about 17:1.0.

8. A concentrate according to claim 7, where: wherein m and n are, each independently, from 6 to 12; x is from 6 to 12; y is from 2 to 25; z<y; and the ratio of the amount of component (B) to the amount of component (A) is from about 6.5:1.0 to about 15.0:1.0.

9. A concentrate according to claim 1, wherein m and n are, each independently, from 4 to 14, x is from 4 to 14; $R_1$ and $R_2$ each independently has from 14 to 18 carbon atoms; $R_1$ is selected from a saturated and an unsaturated straight and branched chain aliphatic monovalent hydrocarbon moiety substituent bearing phenyl moieties in which the aromatic ring in the phenyl moiety is directly bonded to the oxygen atom appearing immediately after the $R_1$ symbol in formula (II); each of q and q' is from 3 to 4; r is from 28 to 30; each of s and s' is from 26 to 28; t is from 6 to 7; and the ratio of the amount of component (B) to the amount of component (A) is from about 6:1.0 to about 17.0:1.0.

10. A concentrate according to claim 9, wherein m and n are, each independently, from 6 to 12, x is from 6 to 12; $R_1$ comprises nonylphenol molecules and the ratio of the amount of component (B) to the amount of component (A) is from about 6.5:1.0 to about 15:1.0.

11. A concentrate according to claim 9, wherein m and n are, each independently, from 6 to 12, x is from 6 to 12; $R_1$ comprises a nonylphenol moiety; y is from 5 to 15 and the ratio of the amount of component (B) to the amount of component (A) is from about 6.5:1.0 to about 15:1.0.

* * * * *